US008783475B2

(12) United States Patent
Carver et al.

(10) Patent No.: US 8,783,475 B2
(45) Date of Patent: Jul. 22, 2014

(54) HANGING APPAREL STRAP

(76) Inventors: Gretchen A. Carver, Dittmer, MO (US); John W. Carver, Dittmer, MO (US)

( * ) Notice: Subject to any disclaimer, the term of this patent is extended or adjusted under 35 U.S.C. 154(b) by 67 days.

(21) Appl. No.: 13/555,321

(22) Filed: Jul. 23, 2012

(65) Prior Publication Data

US 2014/0021152 A1 Jan. 23, 2014

(51) Int. Cl.

| | |
|---|---|
| ***A47G 29/00*** | (2006.01) |
| ***A47F 5/08*** | (2006.01) |
| ***A47F 7/00*** | (2006.01) |
| ***A47B 81/00*** | (2006.01) |
| ***A47G 25/06*** | (2006.01) |

(52) U.S. Cl.

CPC ..... *A47F 5/0892* (2013.01); *A47G 25/0607* (2013.01)

USPC ..... 211/113; 211/85.3; 211/35; 211/195

(58) Field of Classification Search

CPC ... A47G 25/746; A47G 25/06; A47G 25/067; A47G 25/00; A47G 25/0614; A47B 61/003; A47B 61/04; A47F 5/0006; A47F 5/08; A47F 7/08; A47F 5/0892; A47F 5/0876; D06F 57/12; D06F 57/125; B65D 63/00; B65D 5/4208; B65D 73/0064; B65D 33/14; B65D 25/22; A45C 11/00; A45C 11/26

USPC ..... 211/113, 117, 118, 106.01, 85.3, 85.2, 211/34, 35, 38, 13.1, 85.12, 195, 87.01, 211/104; 206/483, 479, 478, 477, 806, 495

See application file for complete search history.

(56) References Cited

U.S. PATENT DOCUMENTS

| | | | | | |
|---|---|---|---|---|---|
| 496,696 | A | * | 5/1893 | Nash | 211/89.01 |
| 801,821 | A | * | 10/1905 | Baumgartner | 24/440 |
| 1,991,306 | A | * | 2/1935 | Woolsey | 132/312 |
| 4,251,071 | A | * | 2/1981 | Norton | 482/125 |
| 4,387,873 | A | * | 6/1983 | Pavlo et al. | 248/227.1 |
| 4,519,564 | A | * | 5/1985 | Nadherny | 248/58 |
| 4,523,702 | A | * | 6/1985 | Viio | 224/101 |
| 4,749,088 | A | * | 6/1988 | Workman et al. | 211/13.1 |
| 4,932,626 | A | * | 6/1990 | Guillot | 248/548 |
| 5,117,988 | A | * | 6/1992 | Daniels | 211/113 |
| 5,209,344 | A | * | 5/1993 | Smith | 206/6.1 |
| 5,248,036 | A | * | 9/1993 | Radocha et al. | 206/479 |
| 5,370,288 | A | * | 12/1994 | Field | 224/223 |
| 5,427,230 | A | * | 6/1995 | Mattox | 206/6.1 |
| 5,584,455 | A | * | 12/1996 | Artemi | 248/214 |
| D377,123 | S | * | 1/1997 | Hutchens | D6/323 |
| 5,613,614 | A | * | 3/1997 | Richardson | 211/89.01 |
| 5,632,427 | A | * | 5/1997 | Gattuso et al. | 224/309 |
| 6,038,745 | A | * | 3/2000 | Rapp | 24/68 R |
| 6,978,574 | B1 | * | 12/2005 | Valenta | 47/41.11 |
| 7,131,545 | B1 | * | 11/2006 | Grogan | 211/85.29 |

(Continued)

*Primary Examiner* — Jennifer E Novosad

(74) *Attorney, Agent, or Firm* — Husch Blackwell LLP

(57) ABSTRACT

A hanging apparel strap for providing suitable and convenient storage for a variety of items for work, play and/or outdoor activities including a support member, a cord fixedly attached at intermediate locations along the length of the support member, and a plurality of tabs spaced at intermediate intervals along the length thereof. The plurality of tabs allow the cord positioned therebetween to form a plurality of spaced eyelets along the length of the cord for attaching items thereto. The cord extends beyond at least one end portion of the support member and forms a loop for allowing the apparel strap to be hung from a hook or other object.

7 Claims, 2 Drawing Sheets

(56) References Cited

U.S. PATENT DOCUMENTS

| | | | | |
|---|---|---|---|---|
| 7,585,197 | B1 * | 9/2009 | Merten | 441/80 |
| 7,712,641 | B2 * | 5/2010 | Snyder | 223/88 |
| 7,810,654 | B1 * | 10/2010 | Wang | 211/106.01 |
| 7,922,140 | B2 | 4/2011 | Carver | |
| 8,020,712 | B2 * | 9/2011 | Kopp et al. | 211/30 |
| 8,177,075 | B2 * | 5/2012 | Hathorn | 211/34 |
| D661,175 | S * | 6/2012 | Dahl et al. | D8/349 |
| 2008/0142460 | A1 * | 6/2008 | Belokin et al. | 211/113 |

* cited by examiner

HANGING APPAREL STRAP

BACKGROUND OF THE INVENTION

The present invention relates generally to a hanging apparel strap and, more particularly, to a device for storing apparel, footwear, accessories, electronics and related items used by soldiers, campers and other individuals who desire a system for storing various personal belongings in a compact and organized manner and in a way that keeps such items off of the ground.

Active duty military personnel, police officers, firefighters, emergency medical personnel and other such professionals often have a variety of items which they must keep with them because of the nature of their jobs. In addition, individuals who participate in outdoor activities such as camping, backpacking, picnicking, fishing, rafting and hunting often have a variety of items they keep with them for use during the course of their outdoor activities. Oftentimes in these situations, it is difficult for individuals to find suitable and convenient storage for the items needed for the above-described activities. If appropriate storage is unavailable, individuals may not be able to locate the items they desire or items may get lost or damaged. Suitable storage is thus particularly important in these situations where it is desirable to keep items organized so they are easily accessible. In some circumstances, it is preferable to store items off the ground because it keeps the items clean, secure and allows for a clear floor space in compact areas.

Thus, it would be desirable to develop a portable, foldable hanging apparel strap which is attachable to a vertical surface.

SUMMARY OF THE INVENTION

The present invention is directed to a hanging apparel strap securable to any type of vertical support which provides for portable, foldable storage for a variety of items. The hanging apparel strap includes a support member which provides structural support. The support member may further include a cord attached to an outer surface of the support member at intermediate intervals. In one embodiment, tabs may be spaced in pairs at intermediate intervals along the length of the support member over the cord, a first tab being positioned slightly above a second tab. The cord lying between the first and second tabs is not attached to the support member. As a result, the space formed between the first and second tabs allows the cord to form a sleeve or eyelet, each sleeve or eyelet being adapted for receiving an S-hook or other fastening device allowing it to be removably secured thereto. The cord may further extend past one or both ends of the support member thereby forming a loop which allows the hanging apparel strap to be secured to any vertical surface.

Specific advantages and features of the present assembly will be apparent from the accompanying drawings and the description of several illustrative embodiments of the present invention.

DESCRIPTION OF THE DRAWINGS

FIG. 5 is an enlarged perspective view of the section 5 of hanging apparel strap of

FIG. 1.

It should be understood that the present drawings are not necessarily to scale and that the embodiments, disclosed herein are sometimes illustrated by fragmentary views. In certain instances, details which are not necessary for an understanding of the present invention or which render other details difficult to perceive may have been omitted. It should also be understood that the invention is not necessarily limited to the particular embodiments illustrated herein. Like numbers utilized throughout the various figures designate like or similar parts or structure.

DETAILED DESCRIPTION

Figure 1:
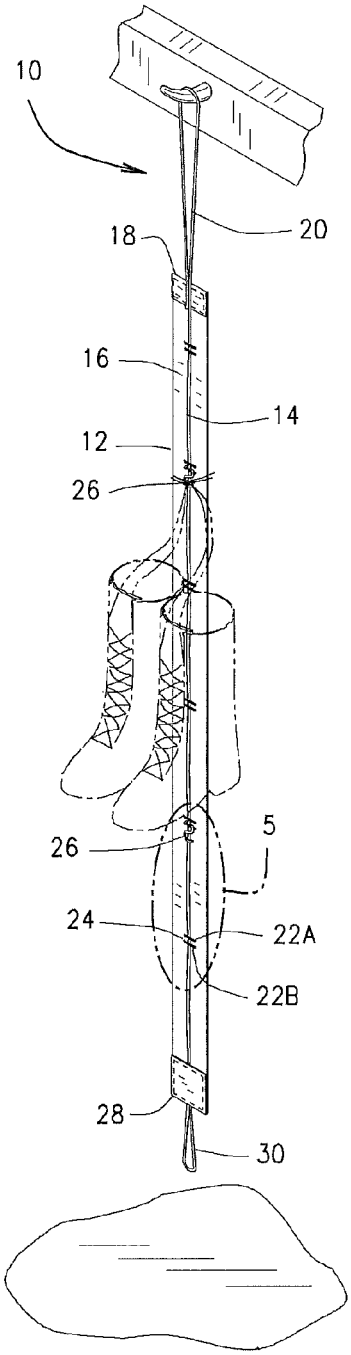
FIG. 1 illustrates a perspective view of one embodiment of a hanging apparel strap constructed in accordance with the teachings of the present invention shown installed on a hook.
Figure 2:
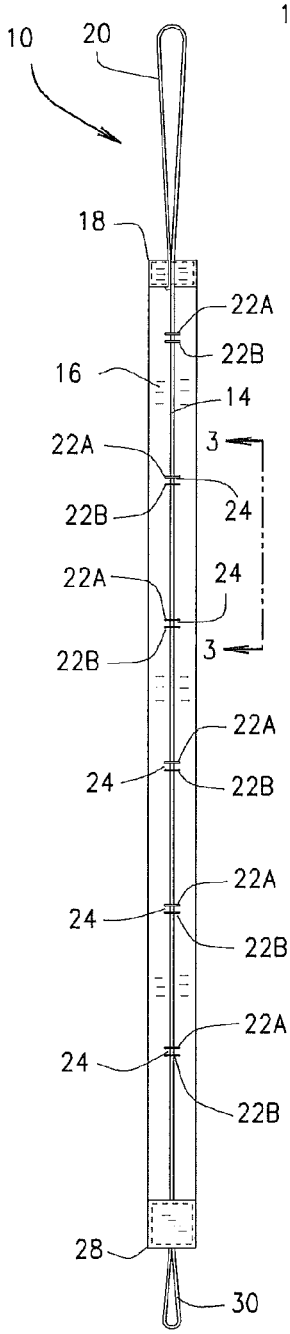
FIG. 2 is a front elevational view of the hanging apparel strap of FIG. 1.
Figure 6:
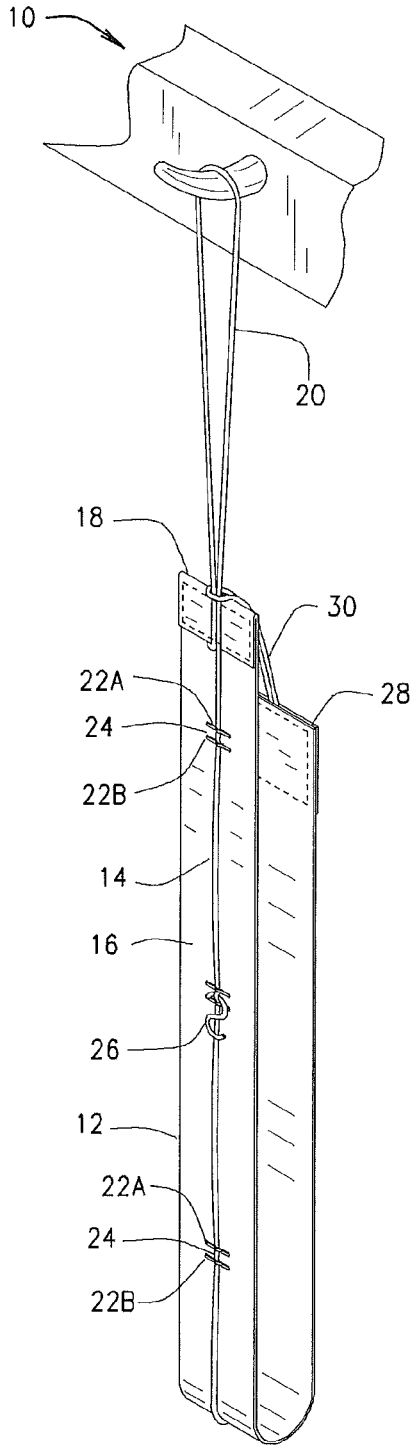
FIG. 6 is a perspective view of the hanging apparel strap of FIG. 1 shown installed on a hook.

Referring now to the drawings more particularly by reference numbers, FIGS. 1, 2 and 6 illustrate one embodiment of a hanging apparel strap 10 which is designed for supporting various items and which is securable to any vertical surface such as a hook, door knob, tent pole, wall bracket, branch, nail or any other similar object for receiving the hanging apparel strap 10 as will be hereinafter further explained. The hanging apparel strap 10 is designed for individuals to create suitable and convenient storage for a wide variety of items needed for work, play and/or outdoor activities. The hanging apparel strap 10 is foldable so that it may be compactly stored when not in use or when it is being transported from one location to another. The storage provided by the hanging apparel strap 10 may allow individuals to easily locate the items they desire and may prevent such items from becoming lost or damaged. In addition, the storage provided by the hanging apparel strap 10 facilitates the organization of items, making them easily accessible. The hanging apparel strap 10 further allows items to be stored off the ground, particularly in an outdoor environment, which will keep the items clean, free from dirt, dust and/or rain water, secure and may allow for a clear floor space in compact areas.

Figure 3:
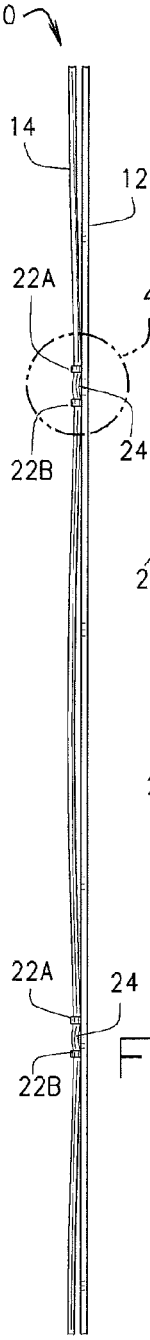
FIG. 3 is a partial side elevational view of the hanging apparel strap of FIG. 2 taken along line 3-3.

As illustrated in FIGS. 1, 2 and 3, the hanging apparel strap 10 includes a support member 12 which provides structural support to the entire unit. The support member 12 may be fashioned from any suitable material such as nylon, leather, cloth, natural fibers or any type of synthetic material. In one embodiment, it is envisioned that the support member is made from a sufficiently flexible material to facilitate the folding and compact storage of the hanging apparel strap 10 when it is not in use.

The support member 12 further includes a cord 14 attached to an outer surface 16 of the support member 12 at intermediate intervals along its length. In one embodiment, the cord 14 may be secured to the support member 12 by stitching, adhesives, fusion bonding or by any other coupling process. In another embodiment, the cord 14 may be secured solely by the tabs 22 as will be hereinafter explained. The cord 14 may extend past a first end 18 of the support member 12 thereby forming a first loop 20 which allows the hanging apparel strap 10 to be secured to any vertical surface or other object.

Figure 4:
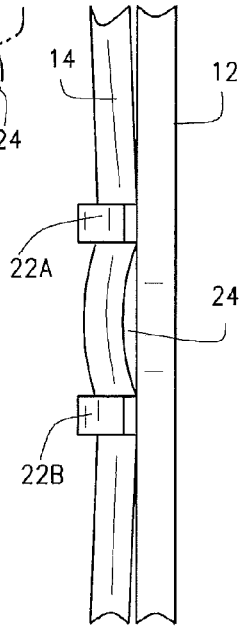
FIG. 4 is an enlarged partial perspective view of section 4 of the hanging apparel strap of FIG. 3 showing one sleeve or eyelet associated therewith.
Figure 5:
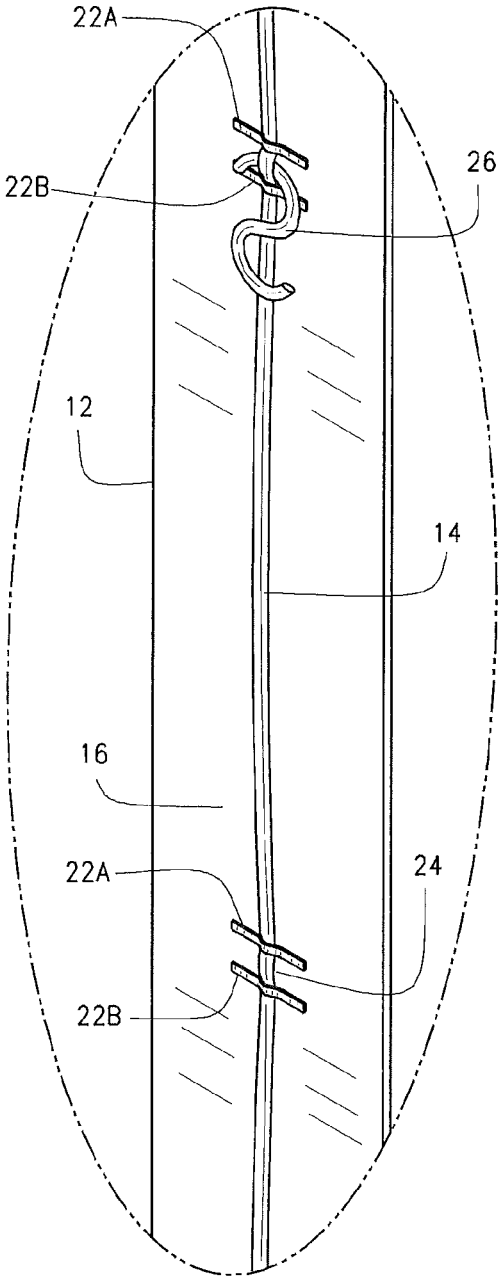

As best illustrated in FIGS. 4 and 5, the cord 14 may be attached to the support member 12 by a plurality of tabs 22. In one embodiment, the tabs 22 may be spaced in pairs at intermediate intervals along the length of member 12 over the cord 14, a first tab 22A being positioned slightly above a second tab 22B so as to form a space therebetween. The space between the first tab 22A and the second tab 22B allows the cord 14 therebetween to form a sleeve or eyelet 24 therebetween, each sleeve or eyelet 24 being adaptable to receive one end portion of an S-hook 26 as best illustrated in FIG. 5 thereby allowing the S-Hook 26 to be removably attached to the sleeve or eyelet 24. In this regard, the cord 14 is not attached to the support member 12 between the tabs 22A and 22B thereby allowing the eyelet 24 to be formed. In alternative embodiments, each sleeve or eyelet 24 could be used for receiving a variety of different types of fastening devices such as J-hooks, C-hooks and the like without departing from the spirit and scope of the present invention. In still another embodiment, items having fastening devices associated therewith may be secured directly to each sleeve or eyelet 24 thereby making the use of the S-hooks 26 or other similar devices optional, depending on the type of item to be stored on the strap 10.

In the embodiment illustrated in FIGS. 1-6, the cord 14 extending between each respective pair of tabs 22 is not attached to the support member 12. In this embodiment, the cord 14 is attached to the member 12 solely by the tab 22 and at the respective ends of the support member 12. It is also recognized and anticipated that the cord 14 can be fixedly attached to the support member 12 between the respective pairs of tabs 22 by any suitable means such as by stitching, adhesives, fusion bonding or other means so long as that portion of the cord 14 extending between the respective tabs 22A and 22B remains unattached to the support member 12 so that the eyelets 24 can be formed.

In one embodiment, the cord 14 may also extend past a second end 28 of the support member 12 also forming a second loop 30 at the opposite end. As illustrated in FIG. 6, the first loop 20 may be threaded through the second loop 30, or vice versa, to allow the hanging apparel strap 10 to be folded upon itself when less storage is required and/or when less vertical space for use of the hanging apparel strap 10 is available. It is further envisioned that the first loop 20 and the second loop 30 may be secured to separate surfaces or objects thereby creating a horizontal storage device which may also be used for hanging items as referenced above including wet or damp clothes or other items needed to be kept out of the reach of children and/or animals. It is also recognized that the size of the first and second loops 20 and 30 may be same, or they may vary relative to each other.

Thus, there has been shown and described an embodiment of a novel hanging apparel strap. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A hanging apparel strap for attaching items thereto comprising:

a support member having a length and a width, said support member being continuous along its width;

a cord extending along the length of said support member;

a plurality of pairs of tabs fixedly attached to said support member and extending over said cord at intermediate locations along the length thereof, said cord being unattached to said support member at the respective locations between said respective pairs of tabs;

said cord extending beyond at least one end portion of said support member forming a loop at a first end of said support member for securing the hanging apparel strap to a surface; and each respective pair of tabs allowing the unattached cord extending therebetween to form an eyelet for attaching items thereto.

2. The hanging apparel strap of claim 1 wherein said strap further includes one or more S-hooks, each said S-hook engaging a said eyelet and being removably attachable thereto.

3. The hanging apparel strap of claim 1 wherein said strap further includes one of a J-hook and C-hook, each of one of said J-hook and C-hook engaging a said eyelet and being removably attachable thereto.

4. The hanging apparel strap of claim 1 wherein said cord further extends beyond the opposite end portion of said support member forming a second loop at a second end of said support member for securing the hanging apparel strap to a surface.

5. The hanging apparel strap of claim 1 wherein said plurality of pairs of tabs attach said cord to said support member.

6. A hanging apparel strap for attaching items thereto comprising:

a support member having a length and a width, said support member being continuous along its width;

a cord extending along the length of said support member;

a plurality of pairs of tabs fixedly attached to said support member and extending over said cord at spaced locations along the length of said cord, said cord being unattached to said support member at the respective locations between said respective pairs of tabs;

said cord extending beyond both opposite end portions of said support member forming a loop at each opposite end thereof for securing the hanging apparel strap to a surface; and each respective pair of tabs allowing the unattached cord extending therebetween to form an eyelet for attaching items thereto;

a variety of different items being attachable to said eyelets.

7. The hanging apparel strap of claim 6 further including a plurality of S-hooks, each S-hook being removably attachable to an eyelet.

* * * * *